US005218741A

United States Patent [19]

Leifeld et al.

[11] Patent Number: 5,218,741

[45] Date of Patent: Jun. 15, 1993

[54] TEXTILE FIBER MIXER

[75] Inventors: Ferdinand Leifeld, Kempen, Fed. Rep. of Germany; Friedrich Fischer, Landgraaf, Netherlands

[73] Assignee: Trützschler GmbH & Co. KG, Monchen-Gladbach, Fed. Rep. of Germany

[21] Appl. No.: 867,437

[22] Filed: Apr. 13, 1992

[30] Foreign Application Priority Data

Apr. 12, 1991 [DE] Fed. Rep. of Germany ..... 4111894

[51] Int. Cl.[5] ..... D01G 13/00

[52] U.S. Cl. ..... 19/145.5; 19/105

[58] Field of Search ..... 19/105, 145.5, 145.7, 19/296, 297, 80 R, 97.5, 200, 204, 205

[56] References Cited

U.S. PATENT DOCUMENTS 4,527,306 7/1985 Thannheiser ..... 19/105 X
4,531,262 7/1985 Reiche ..... 19/105 X
5,010,623 4/1991 Marzoli et al. ..... 19/145.5

FOREIGN PATENT DOCUMENTS 1915266 11/1971 Fed. Rep. of Germany .
3740616 6/1989 Fed. Rep. of Germany .
3916986 11/1990 Fed. Rep. of Germany .
2518586 6/1983 France ..... 19/200
3051320 3/1991 Japan ..... 19/145.5
1298269 3/1987 U.S.S.R. .
1348388 10/1987 U.S.S.R. ..... 19/5 A
1036836 7/1966 United Kingdom ..... 19/145.5
2127446 4/1984 United Kingdom ..... 19/105

*Primary Examiner*—Clifford D. Crowder
*Assistant Examiner*—Larry D. Worrell
*Attorney, Agent, or Firm*—Spencer, Frank & Schneider

[57] ABSTRACT

An apparatus for mixing textile fiber tufts includes a plurality of serially disposed, generally vertically oriented hoppers; a pneumatic conveying system for advancing an air/tuft mixture to the hoppers for charging the hoppers with fiber tufts from the top; an exhaust-air chamber for receiving the conveying air stream from the air/tuft mixture; and a separator positioned between the exhaust-air chamber and the hoppers for allowing air to enter the exhaust-air chamber and for retaining fiber tufts in the hoppers. There are further provided a mixing chamber extending underneath the hoppers; an arrangement situated at the bottom of each hopper for delivering fiber tufts from the hoppers to the mixing chamber; and a transporting device situated in the mixing chamber for mechanically removing blended fiber tufts therefrom. The apparatus also has a septum for separating the exhaust-air chamber from the mixing chamber in an airtight manner; and an air suction arrangement communicating with the mixing chamber for removing air therefrom.

14 Claims, 2 Drawing Sheets

TEXTILE FIBER MIXER

CROSS REFERENCE TO RELATED APPLICATION

This application claims the priority of German Application No. P 41 11 894.4 filed Apr. 12, 1991, which is incorporated herein by reference.

BACKGROUND OF THE INVENTION

This invention relates to an apparatus for mixing (blending) textile fibers such as cotton or chemical fibers or the like and is of the type which has a plurality of serially arranged hoppers which are charged with fibers from above by a common pneumatic fiber conveying device. The fiber material is withdrawn from the hoppers at their lower end, for example, by means of delivery rolls cooperating with opening rolls and transported by a common conveyor through a fiber mixing chamber. The conveying air is separated from the fiber tufts and is guided through air outlet openings into an exhaust-air chamber.

In a mixer of conventional structure, the conveying air is guided through perforated plates in the upper part of the chamber into lateral exhaust channels and from there the air is introduced into the mixing chamber underneath the opening rolls at the bottom of the hoppers. The opening rolls advance the fiber material (fiber tufts) into the mixing chamber from which they are drawn away by suction by means of an after-connected condenser having a screen drum and a suction output which is at least 3,600 $m^3$/hr. The loose fiber tufts are in a floating state in the mixing chamber as they are withdrawn by suction therefrom. The screen drum has a cylindrical surface on which first a densified fiber lap layer is formed from the loosely adhering fiber tufts, and then the fiber material is fed, as a fiber tuft batt, to an after-connected fiber-processing machine, such as a fiber cleaner. Such an arrangement is complex and expensive; it is a further disadvantage that the separated conveying air which is also used for removing the mixed fiber tufts has a certain dust content.

SUMMARY OF THE INVENTION

It is an object of the invention to provide an improved apparatus of the above-outlined type from which the discussed disadvantages are eliminated and in which a dust deposition on the machine components or on the delivered fiber material is avoided.

This object and others to become apparent as the specification progresses, are accomplished by the invention, according to which, briefly stated, the apparatus for mixing textile fiber tufts includes a plurality of serially disposed, generally vertically oriented hoppers; a pneumatic conveying system for advancing an air/tuft mixture to the hoppers for charging the hoppers with fiber tufts from the top; an exhaust-air chamber for receiving the conveying air stream from the air/tuft mixture; a separator positioned between the exhaust-air chamber and the hoppers for allowing air to enter the exhaust-air chamber and for retaining fiber tufts in the hoppers; a mixing chamber extending underneath the hoppers; an arrangement situated at the bottom of each hopper for delivering fiber tufts from the hoppers to the mixing chamber; a transporting device situated in the mixing chamber for mechanically removing blended fiber tufts therefrom; a septum for separating the exhaust-air chamber from the mixing chamber in an air-tight manner; and an air suction arrangement communicating with the mixing chamber for removing air therefrom.

By separating the exhaust-air chamber from the fiber mixing chamber the conveying air may be removed without contacting the blended fiber tufts. In this manner, a dust penetration into the fiber mixing chamber and into the fiber tufts and a deposition of dust is prevented. The fiber mixing chamber is exposed to suction directly or indirectly, resulting in a further advantageous measure for dust elimination. By virtue of the mechanical removal, an after-connected condenser as known from the prior art may be dispensed with, whereby the apparatus is simplified and high suction outputs are no longer required. At the same time, the mechanical removal makes possible a direct forming of a layer-like condensed fiber tuft mass which, as a fiber batt, is fed directly to the feeding device of an after-connected machine such as a fiber cleaner.

DESCRIPTION OF THE PREFERRED EMBODIMENT

It is noted at the outset that in the Figures the solid black arrows indicate a stream of fiber tufts, the arrows shown in outline indicate air streams, whereas the half-solid, half-white arrows indicate a stream of an air/fiber mixture.

Figure 1:
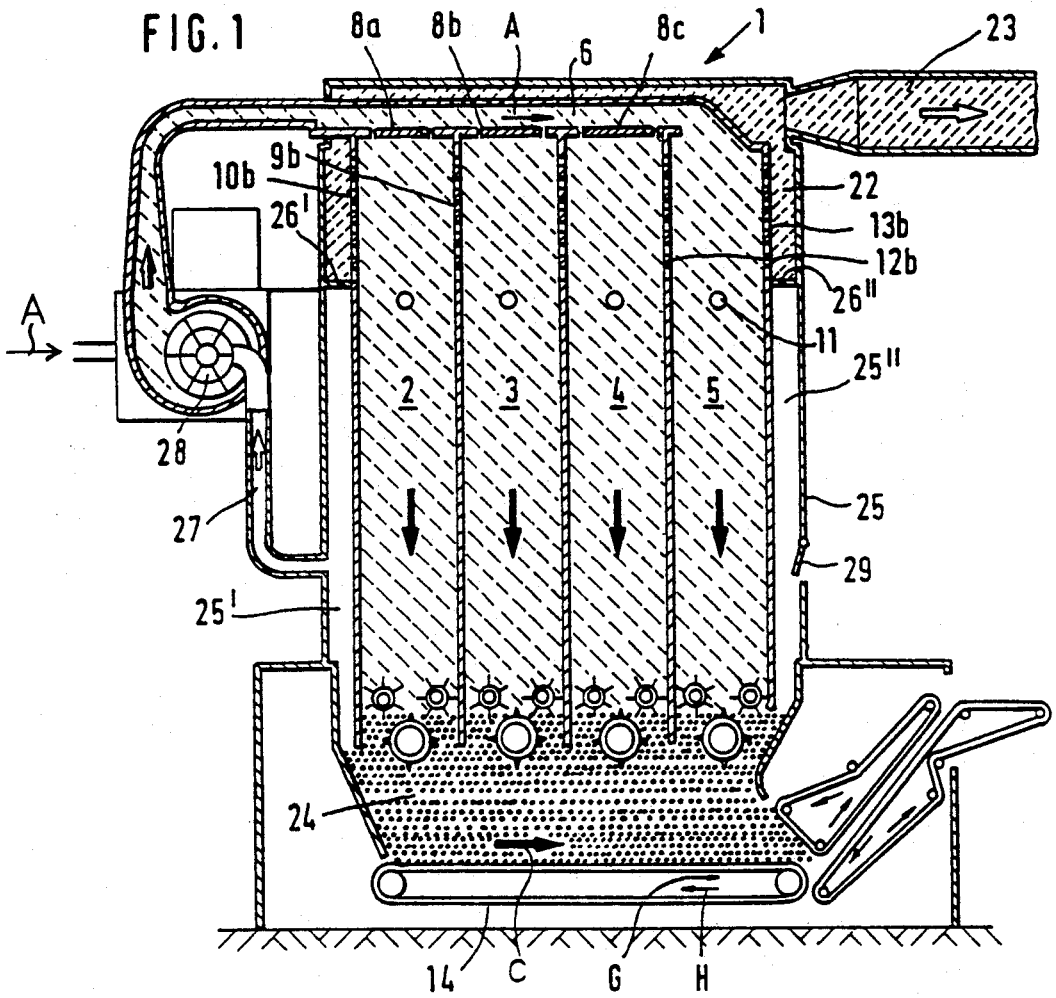
FIG. 1 is a schematic side elevational view of a fiber tuft mixing apparatus incorporating a preferred embodiment of the invention.
Figure 7:
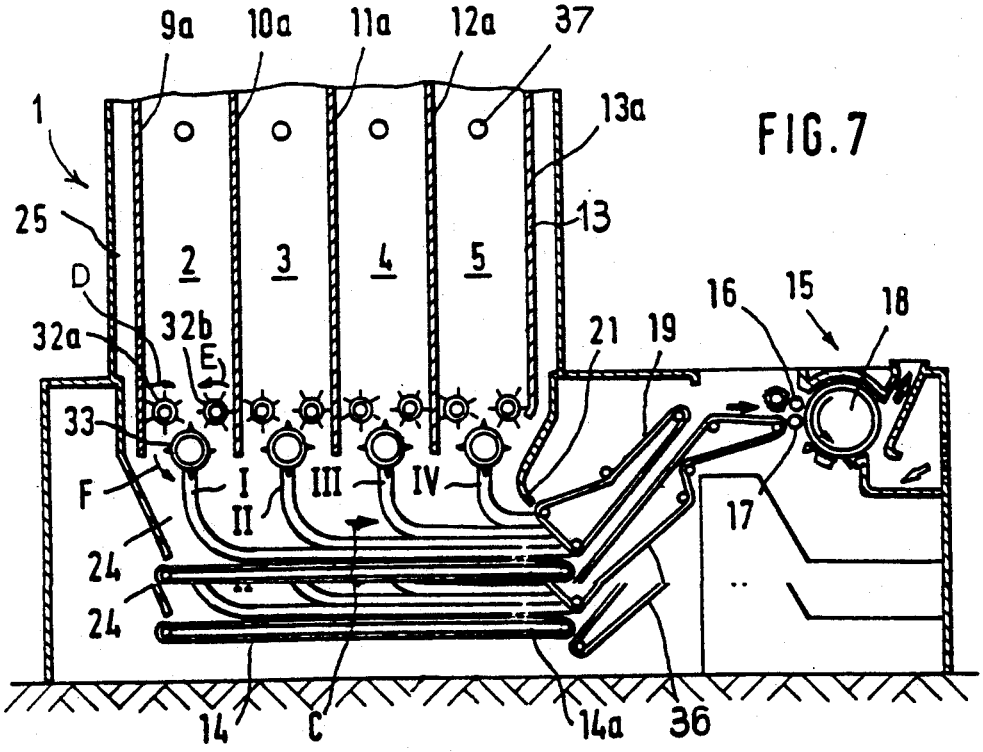
FIG. 7 is a schematic side elevational view showing a blending apparatus similar to FIG. 1, followed by a fiber cleaning apparatus.

Turning to FIGS. 1 and 7, there is illustrated therein a fiber mixer 1 having a series of four hoppers 2, 3, 4 and 5 coupled at the top to a common conduit 6 through which the fiber tufts are conveyed by an air stream in the direction of the arrow A. Underneath the conduit 6 the hopper walls 9–13 each have an air-impervious zone **9*a*–13*a* and an upper zone 9*b*–13*b* provided with air outlet openings to render that zone air-pervious. Above the hoppers 2, 3 and 4 rotatable gates 8*a*, 8*b* and 8*c* are arranged which distribute the fiber tufts into the hoppers 2, 3 and 4. In each hopper 2–5 there is positioned a photocell 37 functioning as a safety device which protects against overfill or empty run. The photocells 37 are connected with an upstream-arranged drive motor (not shown) for the fiber transporting stream. Underneath the hoppers 2–5 a common conveyor belt (mixing belt) 14 is situated which advances the fiber mass I–IV deposited thereon from the hoppers 2–5 in the direction of arrow C toward a further fiber processing machine, such as a cleaner 15. In the zone of the lower end of each hopper 2–5 delivery rolls 32***a*, 32*b* (rotating in directions D and E) as well as a rapidly rotating opening roll 33 (rotating in direction F) are situated.

The hoppers 2–5 are filled from above with fiber approximately to the height of the photocells 37. As soon as the fill height drops below the level of the photocells 37 a resupply from above resumes. All four hoppers 2–5 are simultaneously and continuously emptied from below and the fiber is carried away by the conveyor belt 14.

Figure 2:
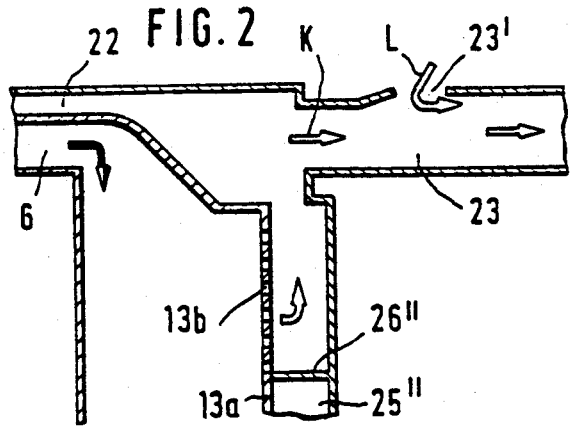
FIG. 2 is a schematic side elevational view of a detail of the structure shown in FIG. 1.

Also referring to FIG. 2, the conveying air separated from the fiber tufts deposited in the hoppers 2–5 is introduced through the air outlet openings 9*b* to 13*b* into a common exhaust-air chamber 2 to which there is connected a suction conduit 23 for removing the conveying air K. Between the opening rolls 33 on the one hand and the upper flight of the conveyor belt 14 a fiber mixing (blending) chamber 24 is situated which is connected with a suction chamber 25 formed of two interconnected chamber parts 25' and 25'' situated laterally of the outer hopper wall portions 9*a* and 13*a*. The chamber parts 25' and 25'' have an upper, air-impervious septum 26' and 26'', respectively, which simultaneously serve as separators between the exhaust-air chamber 22 on the one hand and the chamber parts 25', 25'', on the other hand. The exhaust-air chamber 22 and the fiber blending chamber 24 are thus also separated from one another in an airtight manner. In the wall surface of the chamber part 25' an opening is provided to which is coupled, by means of a conduit 27, the intake end of an air/fiber transporting fan 28, whose output end is connected to an upstream end of the conduit 6. In this manner, dust-laden air is removed by suction from the fiber blending chamber 2 by the fan 28 with the intermediary of the suction chamber 25 and the suction conduit 27.

Reverting once again to FIG. 2, the suction conduit 23 for the exhaust air K is provided with an aperture 23' through which external air (fresh air) L enters from the surrounding atmosphere. The fresh air flow renders the dust content in the conduit 23 thinner and causes turbulence thereof to enhance its conveyance in the conduit 23. The suction conduit 23 is connected to a non-illustrated suction source such as a suction fan in an air conditioning system. In this manner, an open exhaust air withdrawal is ensured and a separation of air is effected between the supply of the blender 1 and the air conditioning apparatus.

Figure 3:
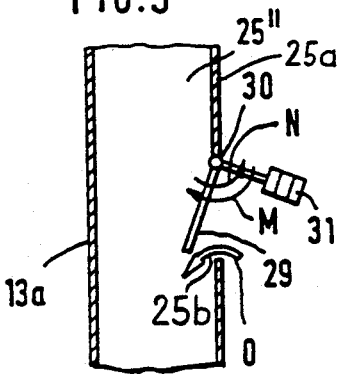
FIG. 3 is a schematic side elevational view showing an air inlet opening in the wall of a suction chamber, forming part of the invention.

Turning to FIG. 3, in the outer wall 25*a* of the chamber part 25'' an opening 25*b* is provided which is controlled by an inwardly pivotal gate 29 hingedly secured to the wall 25*a* at 30 and biased open by a weight 31. The gate 29 is thus pivotal as indicated by the arrows N and M and the weight 31 provides for a self-adjustment by virtue of the balancing effect of the vacuum stream and the entering external air stream O.

Figure 4:
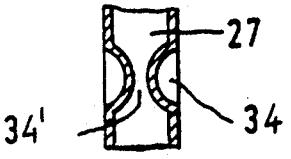
FIG. 4 is a schematic side elevational view of a throttle provided in the suction conduit according to the invention.

According to FIG. 4, in the suction conduit 27 a throttle 34 is arranged whose open flow passage area 34' is adjustable in a non-illustrated manner. Upon a one-time calibration of the throttled cross section 34' a correctly dosed suction of the fiber blending chamber 24 is maintained even in case of fluctuating air flow rates. The closed circuit of the bypass air stream renders unnecessary the heretofore required additional exhaust-air stream and associated filter. Further, a shortest air path for the suction air is achieved to which the fiber blending chamber 24 is exposed.

Figure 5:
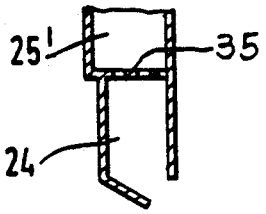
FIG. 5 is a schematic side elevational view of a device for separating fiber from air between a fiber mixing chamber and a suction chamber according to the invention.

Turning to FIG. 5, a perforated sheet metal member 35 is positioned between the chamber part 25' and the fiber blending chamber 24. The size of the apertures in the plate 35 are so designed that they allow passage of air but retain fiber material. The size and number of openings in the plate 35 may be so selected that the apertured plate 35 functions as a throttle for the air stream drawn by the fan 28.

Figure 6:
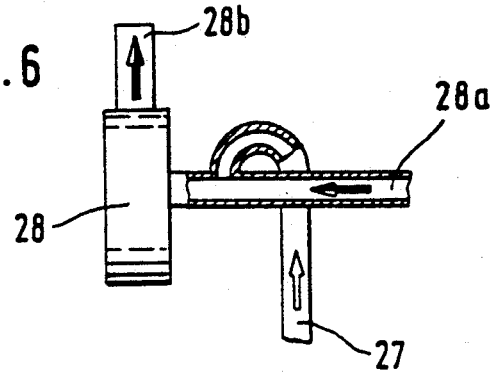
FIG. 6 is a schematic side elevational view showing the coupling of a suction conduit for the suction chamber to the intake side of a fiber transporting fan according to the invention.

Turning to FIG. 6, the conduit 27 is coupled to an upper wall part of the suction conduit 28*a* of the fan 28 whereby fiber material or waste conveyed in the conduit 28*a* is prevented from dropping into the conduit 27 against the weak air stream travelling therein.

Turning to FIG. 7, the mixing belt 14 is, at the discharge end of the blender 1, adjoined by a further conveyor belt 36 which forms part of the mixer 1 and on which the fiber blend, discharged by the conveyor 14, is advanced to the feed rolls 16, 17 of a cleaner 15 which also includes a opening roll 18. Above the conveyor belt 36 a conveyor belt 19 is provided for guiding and compressing the fiber material formed of layers I–IV.

By means of the invention, a horizontal separation between the exhaust-air chamber 22 and the suction chamber 25 is effected by means of the septum 26', 26''.

It will be understood that the above description of the present invention is susceptible to various modifications, changes and adaptations, and the same are intended to be comprehended within the meaning and range of equivalents of the appended claims.

What is claimed is:

1. An apparatus for mixing textile fiber tufts, comprising (a) a plurality of serially disposed, generally vertically oriented hoppers each having a top and a bottom;

(b) a pneumatic conveying means for advancing in air/tuft mixture to the hoppers for charging the hoppers with fiber tufts from the top thereof;

(c) means defining an exhaust-air chamber for receiving a conveying air stream from the air/tuft mixture;

(d) a screen positioned between the exhaust-air chamber and the hoppers for allowing air to enter the exhaust-air chamber and for retaining fiber tufts in the hoppers;

(e) means defining a mixing chamber extending underneath said hoppers;

(f) means situated at the bottom of each hopper for delivering fiber tufts from the hoppers to the mixing chamber;

(g) a fiber tuft transporting device situated in said mixing chamber for mechanically removing blended fiber tufts therefrom;

(h) an air suction means communicating with said mixing chamber for removing air therefrom; said air suction means comprising (1) a suction chamber communicating with said mixing chamber and adjoining said exhaust-air chamber; and (2) a suction generator communicating with said suction chamber; and (i) means for separating said exhaust-air chamber from said suction chamber in an airtight manner.

2. An apparatus for mixing textile fiber tufts, comprising (a) a plurality of serially disposed, generally vertically oriented hoppers each having a top and a bottom;

(b) a pneumatic conveying means for advancing in air/tuft mixture to the hoppers for charging the hoppers with fiber tufts from the top thereof;

(c) means defining an exhaust-air chamber for receiving a conveying air stream from the air/tuft mixture;

(d) a screen positioned between the exhaust-air chamber and the hoppers for allowing air to enter the exhaust-air chamber and for retaining fiber tufts in the hoppers;

(e) means defining a mixing chamber extending underneath said hoppers;

(f) means situated at the bottom of each hopper for delivering fiber tufts from the hoppers to the mixing chamber;

(g) a fiber tuft transporting device situated in said mixing chamber for mechanically removing blended fiber tufts therefrom;

(h) an air suction means communicating with said mixing chamber for removing air therefrom; said air suction means comprising a suction chamber communicating with said mixing chamber and adjoining said exhaust-air chamber; said suction chamber and a hopper adjoining the suction chamber wherein said suction chamber and said hopper have a common side wall; and (i) means for separating said exhaust-air chamber from said suction chamber in an airtight manner.

3. An apparatus for mixing textile fiber tufts, comprising (a) a plurality of serially disposed, generally vertically oriented hoppers each having a top and a bottom;

(b) a pneumatic conveying means for advancing in air/tuft mixture to the hoppers for charging the hoppers with fiber tufts from the top thereof;

(c) means defining an exhaust-air chamber for receiving a conveying air stream from the air/tuft mixture;

(d) a screen positioned between the exhaust-air chamber and the hoppers for allowing air to enter the exhaust-air chamber and for retaining fiber tufts in the hoppers;

(e) means defining a mixing chamber extending underneath said hoppers;

(f) means situated at the bottom of each hopper for delivering fiber tufts from the hoppers to the mixing chamber;

(g) a fiber tuft transporting device situated in said mixing chamber for mechanically removing blended fiber tufts therefrom;

(h) an air suction means communicating with said mixing chamber for removing air therefrom; said air suction means comprising a suction chamber communicating with said mixing chamber and adjoining said exhaust-air chamber;

(i) means for separating said exhaust-air chamber from said suction chamber in an airtight manner; and (j) means for defining an aperture between said mixing chamber and said suction chamber, said aperture being sized such as to allow passage of air and prevent passage of fiber tufts.

4. An apparatus as defined in claim 3, wherein said means defining an aperture comprises a perforated plate member.

5. An apparatus for mixing textile fiber tufts, comprising (a) a plurality of serially disposed, generally vertically oriented hoppers each having a top and a bottom;

(b) a pneumatic conveying means for advancing in air/tuft mixture to the hoppers for charging the hoppers with fiber tufts from the top thereof;

(c) means defining an exhaust-air chamber for receiving a conveying air stream from the air/tuft mixture;

(d) a screen positioned between the exhaust-air chamber and the hoppers for allowing air to enter the exhaust-air chamber and for retaining fiber tufts in the hoppers;

(e) means defining a mixing chamber extending underneath said hoppers;

(f) means situated at the bottom of each hopper for delivering fiber tufts from the hoppers to the mixing chamber;

(g) a fiber tuft transporting device situated in said mixing chamber for mechanically removing blended fiber tufts therefrom;

(h) an air suction means communicating with said mixing chamber for removing air therefrom; said air suction means comprising a suction chamber communicating with said mixing chamber and adjoining said exhaust-air chamber; and (i) means for separating said exhaust-air chamber from said suction chamber in an airtight manner; said means for separating said exhaust-air chamber from said suction chamber comprising a septum situated between said exhaust-air chamber and said suction chamber at a level below said screen.

6. An apparatus as defined in claim 5, wherein said septum lies in a horizontal plane.

7. An apparatus for mixing textile fiber tufts, comprising (a) a plurality of serially disposed, generally vertically oriented hoppers each having a top and a bottom;

(b) a pneumatic conveying means for advancing an air/tuft mixture to the hoppers for charging the hoppers with fiber tufts from the top thereof; said pneumatic conveying means comprising a fan having an output side for generating a conveying air stream and an intake side;

(c) means defining an exhaust-air chamber for receiving a conveying air stream from the air/tuft mixture;

(d) a screen positioned between the exhaust-air chamber and the hoppers for allowing air to enter the exhaust-air chamber and for retaining fiber tufts in the hoppers;

(e) means defining a mixing chamber extending underneath said hoppers;

(f) means situated at the bottom of each hopper for delivering fiber tufts from the hoppers to the mixing chamber;

(g) a fiber tuft transporting device situated in said mixing chamber for mechanically removing blended fiber tufts therefrom;

(h) an air suction means communicating with said mixing chamber for removing air therefrom; said air suction means comprising a suction chamber communicating with said mixing chamber and adjoining said exhaust-air chamber;

(i) means for separating said exhaust-air chamber from said suction chamber in an airtight manner; and (j) a conduit coupling said suction chamber with said intake side of said fan.

8. An apparatus as defined in claim 7, further comprising an air throttle positioned in said conduit.

9. An apparatus as defined in claim 8, further comprising means for permanently setting an open cross section of said air throttle.

10. An apparatus as defined in claim 7, wherein said conduit is a first conduit; further comprising a generally horizontally oriented second conduit coupled to said intake side of said fan; said first conduit extending from below said second conduit and merging into said second conduit at an upper wall part of said second conduit.

11. An apparatus for mixing textile fiber tufts, comprising (a) a plurality of serially disposed, generally vertically oriented hoppers each having a top and a bottom;

(b) a pneumatic conveying means for advancing in air/tuft mixture to the hoppers for charging the hoppers with fiber tufts from the top thereof;

(c) means defining an exhaust-air chamber for receiving a conveying air stream from the air/tuft mixture;

(d) a screen positioned between the exhaust-air chamber and the hoppers for allowing air to enter the exhaust-air chamber and for retaining fiber tufts in the hoppers;

(e) means defining a mixing chamber extending underneath said hoppers;

(f) means situated at the bottom of each hopper for delivering fiber tufts from the hoppers to the mixing chamber;

(g) a fiber tuft transporting device situated in said mixing chamber for mechanically removing blended fiber tufts therefrom;

(h) an air suction means communicating with said mixing chamber for removing air therefrom; said air suction means comprising a suction chamber communicating with said mixing chamber and adjoining said exhaust-air chamber; said suction chamber having a bounding wall;

(i) means for separating said exhaust-air chamber from said suction chamber in an airtight manner; and (j) means defining an opening in said wall for admitting ambient air to said suction chamber.

12. An apparatus as defined in claim 11, wherein said means defining an opening comprises an aperture in said bounding wall and a gate movably attached to said bounding wall and cooperating with said aperture for varying an open air passage area thereof.

13. An apparatus as defined in claim 12, wherein said means defining an opening further comprises means for a self-adjustment of said gate.

14. An apparatus as defined in claim 13, wherein said means for a self-adjustment comprises a hinge for pivotally securing said gate to said bounding wall for a swinging motion about a horizontal axis and a weight attached to said gate.

* * * * *